US007508355B2

(12) United States Patent
Tseng et al.

(10) Patent No.: US 7,508,355 B2
(45) Date of Patent: Mar. 24, 2009

(54) METHOD FOR RECOGNIZING VIDEO SIGNAL TIMING OF ANALOG INPUT

(75) Inventors: Shih-Hua Tseng, Taipei (TW); Wen-Chang Yang, Taipei (TW)

(73) Assignee: Tatung Co., Ltd, Taipei (TW)

( * ) Notice: Subject to any disclaimer, the term of this patent is extended or adjusted under 35 U.S.C. 154(b) by 756 days.

(21) Appl. No.: 11/121,021

(22) Filed: May 4, 2005

(65) Prior Publication Data

US 2006/0139345 A1 Jun. 29, 2006

(30) Foreign Application Priority Data

Dec. 29, 2004 (TW) ..... 93141125 A

(51) Int. Cl.
*G09G 5/00* (2006.01)

(52) U.S. Cl. ..... 345/3.1; 345/3.3; 345/3.4

(58) Field of Classification Search ..... 345/60, 345/74.1, 76, 87, 94–100, 204, 208–214, 345/699, 3.3–3.4
See application file for complete search history.

(56) References Cited

U.S. PATENT DOCUMENTS 6,377,251 B1 * 4/2002 Takasu et al. ..... 345/204
6,791,623 B1 * 9/2004 Masuda et al. ..... 348/563
6,927,767 B1 * 8/2005 Ouchi ..... 345/213

* cited by examiner

*Primary Examiner*—Richard Hjerpe
*Assistant Examiner*—Mansour M Said
(74) *Attorney, Agent, or Firm*—Lowe Hauptman Ham & Berner, LLP

(57) ABSTRACT

The present invention relates to a method applied on displays for recognizing video signal timing of analog input. The present invention employs the horizontal-synchronized-signal interrupt value to distinguish among its inputted video signal timing, allowing to recognize its pixel and correctly display its corresponding video signal timing even when the inputted signal timings share the same horizontal frequency, vertical frequency, and polarity. In case when the display is displaying incorrect video signal timing, the present invention also allows inputting a switch signal to adjust its display mode accordingly, enabling the display to show the correct resolution of the video signal timing under normal operation.

9 Claims, 6 Drawing Sheets

METHOD FOR RECOGNIZING VIDEO SIGNAL TIMING OF ANALOG INPUT

BACKGROUND OF THE INVENTION

1. Field of the Invention

The present invention relates to a method for recognizing signal timings and more particularly, to such a method for recognizing analog-inputted video signal timings, which is utilized on displays.

2. Description of Related Art

Conventionally, display recognizes video signals of analog input according to their horizontal frequency, horizontal polarity, vertical frequency, and vertical polarity, yet some of the inputted signal timing still cannot be recognized by using the technology involved in conventional displays in which it is possible that the inputted signal timing may share both the same horizontal and vertical frequencies, or even the same polarities in some occasion, resulting in signal timing recognition failure.

Moreover, in the prior art technology of display, to display information such as resolution, horizontal and vertical frequencies, and polarities via on screen display (OSD) menu; under circumstances when signal timing cannot be recognized, errors would consequently be displayed and cause inconvenience to users during operations.

SUMMARY OF THE INVENTION

The present invention has been accomplished under the circumstances in view. A method for recognizing video signal timing of analog input applied on displays, using horizontal-synchronized-signal interrupt value to determine inputted signal timing, comprises the steps of: (A) determining whether an inputted signal timing is altered; (B) checking whether the altered signal timing is a default signal timing; (C) deleting the horizontal-synchronized-signal interrupt value; (D) detecting whether a vertical synchronized signal is a positive trigger; if the vertical synchronized signal is not a positive trigger, continuing to detect the vertical synchronized signal until it becomes a positive trigger; (E) determining whether the horizontal-synchronized-signal interrupt value is an initial value; if true, initiating a horizontal-synchronized-signal interrupt enumeration program and repeating step (D); if not true, terminating horizontal-synchronized-signal interrupt value enumeration and obtaining a horizontal-synchronized-signal interrupt value; (F) whenever an interrupt program is interrupted by a horizontal synchronized signal, increasing and accumulating horizontal-synchronized-signal interrupt value; (G) determining whether the horizontal-synchronized-signal interrupt value is greater than a default value; if true, then the inputted signal timing is a first pixel value; if not true; then the inputted signal timing is a second pixel value; and (H) terminating horizontal-synchronized-signal interrupts enumeration. The display mentioned above is preferably a liquid crystal display (LCD); however, cathode ray tube (CRT) displays, plasma displays, and any other displays possessing the same displaying function can also be applied thereon.

A method for recognizing video signal timing of an analog input applied on a display comprises the steps of: (A) calculating specified video-signal-timing parameters and saving the parameters in the display; (B) selecting one set of the specified video-signal-timing display parameters as a default video-signal-timing value; (C) determining whether an inputted video-signal-timing display parameter value matches with the specified video-signal-timing display parameters; if true, maintaining the original video-signal-timing display parameters; if not true, inputting a switch signal from an external device for switching the video-signal-timing display parameters; and (D) outputting the switched video-signal-timing display parameters thereof. The above-mentioned switching signal inputted from the external device is preferably a control-button inputted signal; any other input devices that share the same function can also employ such application, for instance, control buttons on a remote controller.

DETAILED DESCRIPTION OF THE PREFERRED EMBODIMENT

Figure 1:
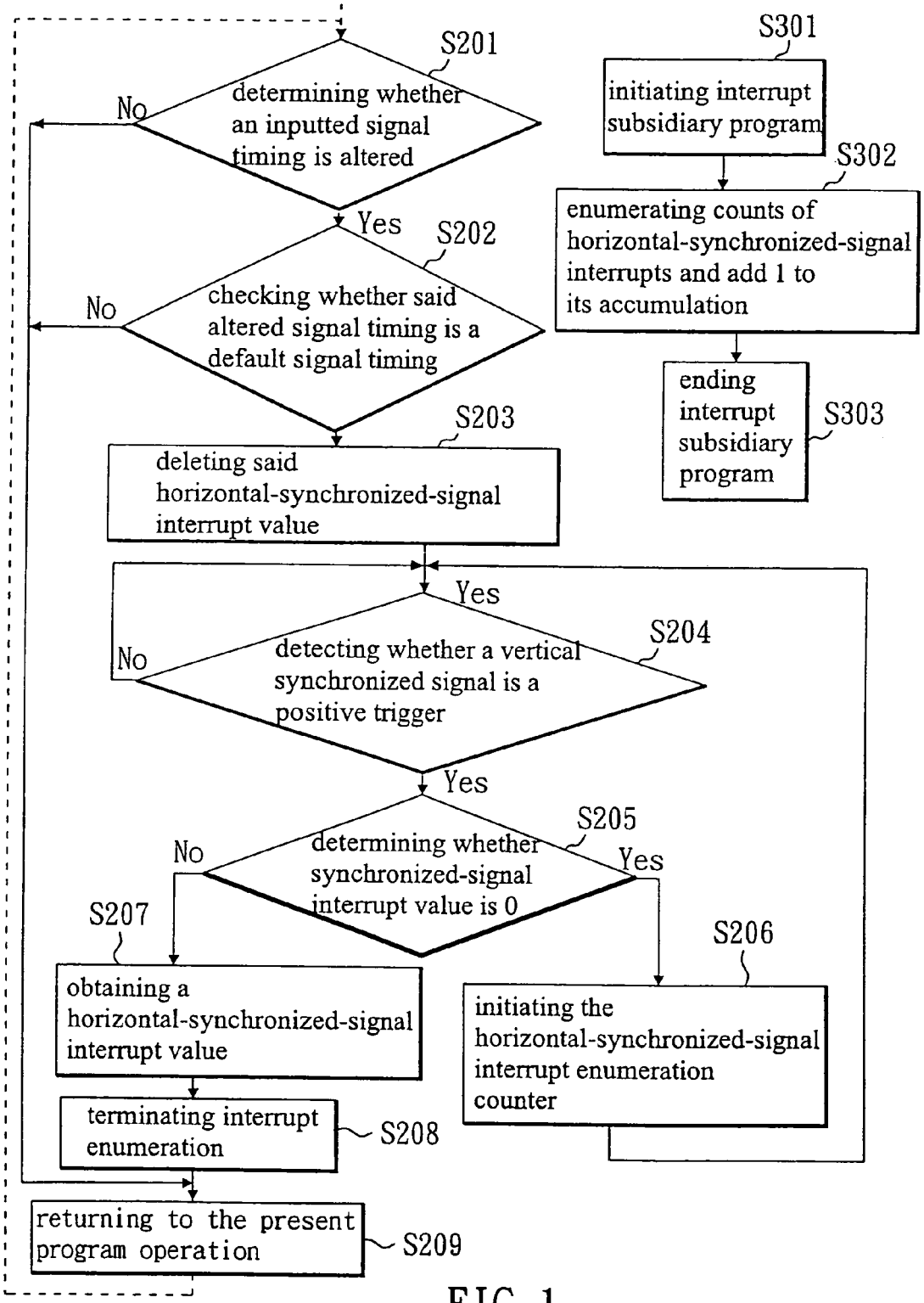
FIG. 1 is a flow chart illustrating a preferred embodiment of the present invention.
Figure 2:
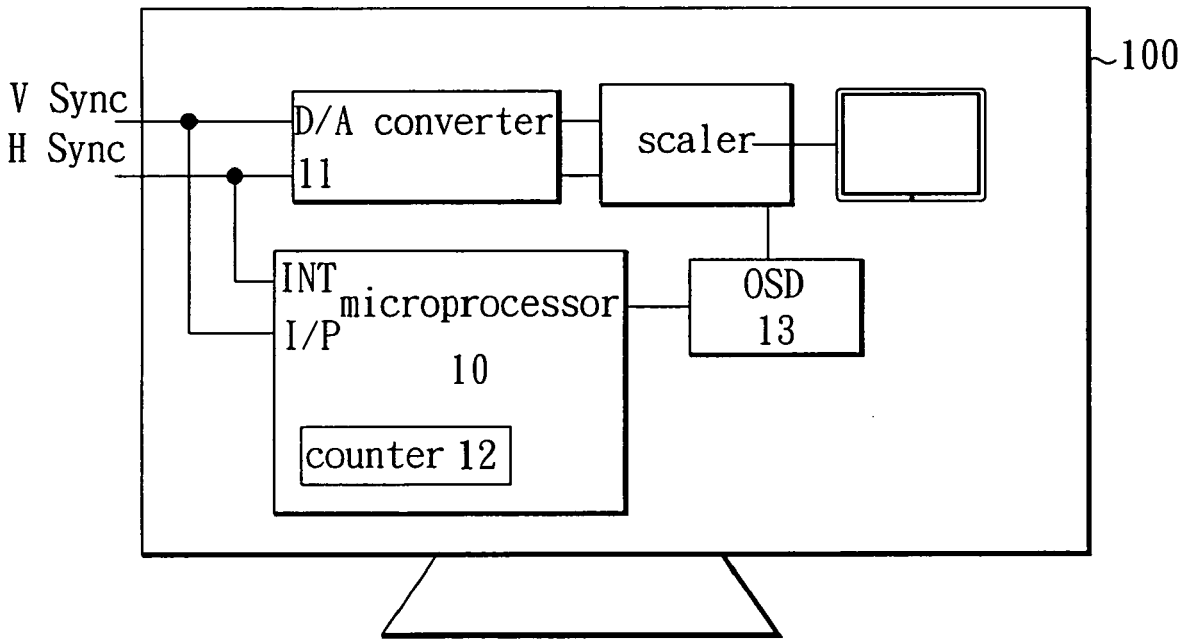
FIG. 2 is a functional block diagram illustrating an embodiment of an LCD according to the present invention.

The present invention has been accomplished under the circumstances in view. Please refer to the flow chart in FIG. 1 together with the functional block diagram in FIG. 2. In this embodiment, the method for recognizing video signal timing of analog input is applied on a liquid crystal display (LCD) 100. In step S201, a microprocessor 10 will first determine whether a signal timing (both vertical- and horizontal-synchronized signals) inputted from an external source is altered. Users usually expose to information, including the resolution, horizontal and vertical frequencies, and polarities of the signal timings, through On Screen Display (OSD) 13 on the liquid crystal display 100. According to the display, if inputted signal timing has been altered, then the altered signal timing shall be checked for whether it matches with the default signal timing according to the present invention (step S202). In this embodiment, default signal timings are 640×350, 720×250, 640×400, and 720×400. Therefore, each 640×400 and 720×400 further contains two sets of signal timings with 60 and 70 Hz vertical frequencies. Since these three pairs of sequences comprised of a total of six sets all share the same frequency and polarity, conventional displays are unable to explicitly distinguish among them. In this embodiment, microprocessor 10 identifies the inputted signal timing according to the calculations of the horizontal-synchronized-signal interrupt value taken place during positive triggers of two vertical-synchronized signals. When microprocessor 10 recognizes that the altered signal timing matches with the default signal timing, the counter 12 will been reset by microprocessor 10. (step S203). As shown in FIG. 2, besides being inputted to analog to digital switcher 11, horizontal-synchronized signals are also connected to INT pin of the microprocessor 10, in which INT pin is utilized to interrupt for the use of enumerating horizontal-synchronized sequence. Besides being inputted to analog to digital switcher 11, the vertical-synchronized signals are also connected to I/P pin of the microprocessor 10, in which I/P pin is utilized to detect beginning and ending of enumerations.

Figure 3:
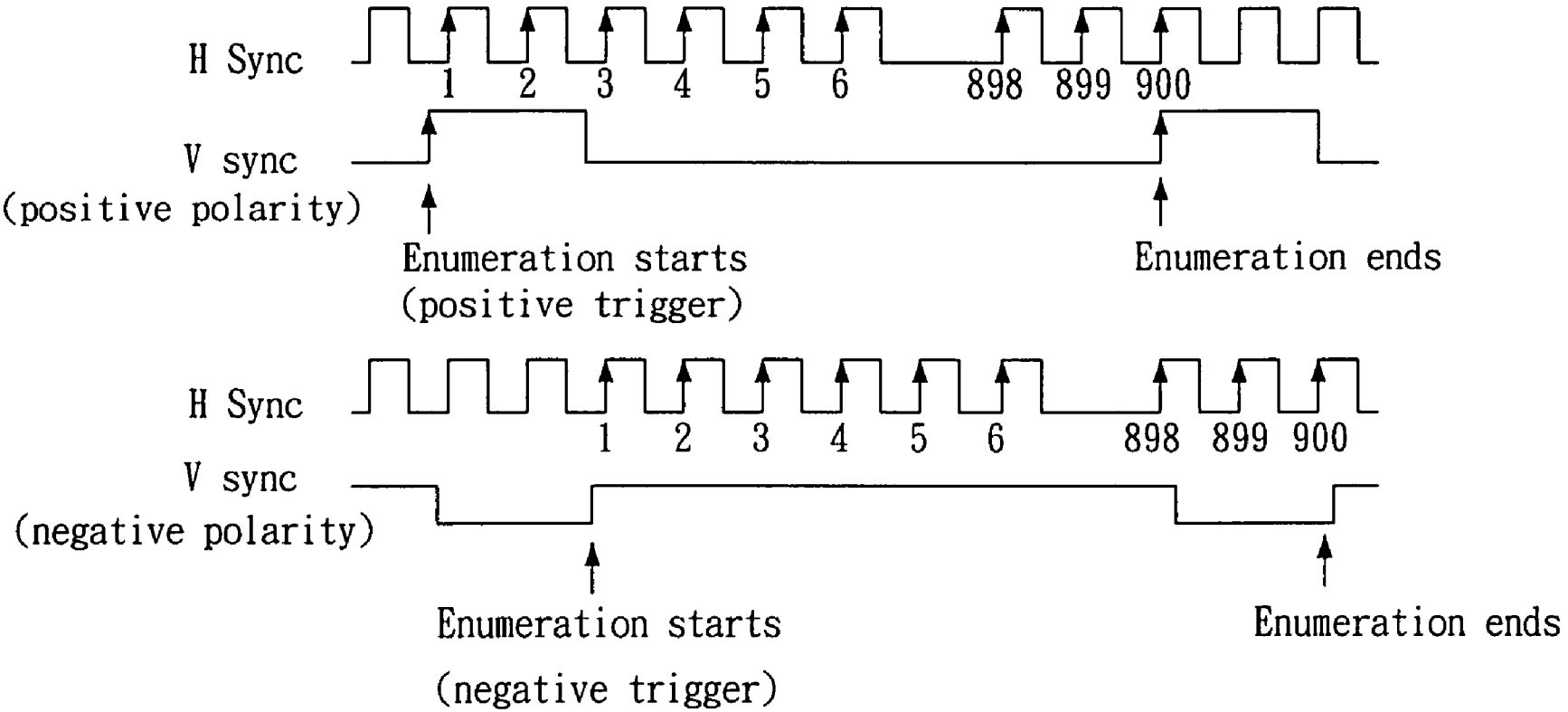
FIG. 3 is a schematic drawing showing a synchronized-signal sequence in a preferred embodiment of the present invention.

As shown FIG. 3, the microprocessor 10 begins to determine signal timings. Since the times of horizontal-synchronized-signal interrupts are calculated according to the time spam that the two vertical-synchronized signal's positive triggers last, vertical-synchronized signals must be firstly detected about whether there is any incoming positive-trigger signal entering in (step S204). If vertical-synchronized signals do not contain any positive-trigger, horizontal-synchronized-signal interrupt enumeration shall then be deferred until a positive-trigger signal is inputted. On the contrary, if a vertical-synchronized-signal positive-trigger signal is inputted, horizontal-synchronized-signal interrupt enumeration shall begin, followed by verification of whether the synchronized-signal interrupt value according to the counter 12 is 0 or otherwise (step S205). If 0, meaning an interrupt occurs at the first time, the interrupting function by INT pin of the microprocessor 10 is initiated (step S206). Each time as the vertical synchronized signal is interrupted, the enumeration adds up one count accordingly (step S301 to S303), and calculation will be terminated at the second vertical-synchronized-signal positive-trigger signal input. When the second vertical-synchronized-signal interrupt value is inputted, the enumeration of the horizontal-synchronized-signal interrupt will be terminated and in the meantime a horizontal-synchronized-signal interrupt value is obtained (step S207). By then the synchronized-signal interrupt value from the counter 12 is no longer 0, and the microprocessor 10 will compare the collected synchronized-signal interrupt value with a default value, in which the default value is 800 in this embodiment. If the synchronized-signal interrupt value is larger than 800, the video sequence input thereof is 720 pixel; on the contrary if the synchronized-signal interrupt value is smaller than 800, the video sequence input thereof is 640 pixel instead, thus making it possible to recognize inputted video sequences from one to another. After the video signal timing has been recognized, the microprocessor 10 will disable the interrupt function of the INT pins, terminating the enumeration of interrupts (step S208). At this stage, since the analog-inputted video signal timing have already been recognized, the liquid crystal display 100 can continue to operate its normal displaying function and return to the present program operation (step S209).

Figure 4:
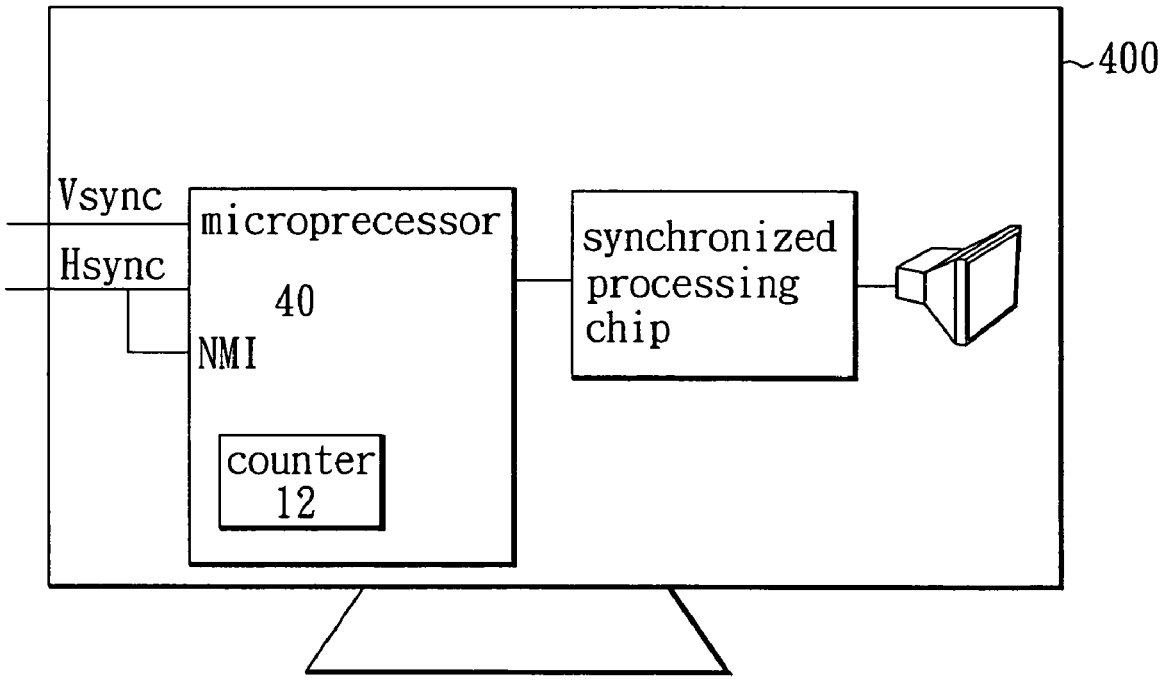
FIG. 4 is a functional block diagram illustrating another embodiment of a CRT according to the present invention.

Further, as shown in FIG. 4, the present invention can also be applied on a cathode-ray tube (CRT) display 400. Because microprocessor 40 can possess the function of detecting the vertical-synchronized-signal interrupt as known in prior art. In this embodiment, it's simply to have horizontal-synchronized signal inputted to NMI (No Mask Interrupt) pins of microprocessor 40 for enumerating synchronized-signal sequences will be sufficient. Other than the aforesaid, the objects achieved by this embodiment coincides with the ones stated in the proceeding paragraph, and thus will not be reiterated herein.

Figure 5:
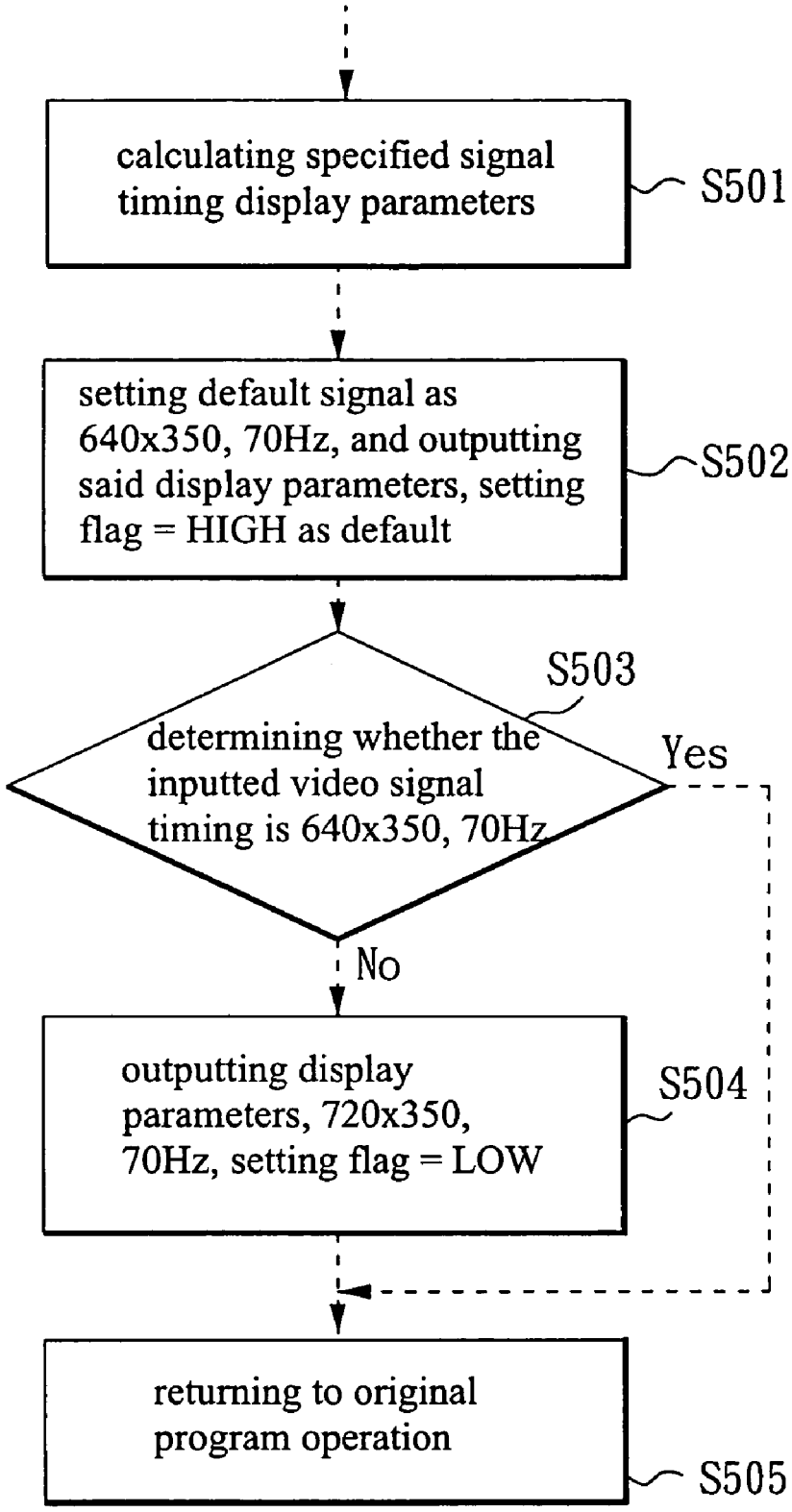
FIG. 5 is a flow chart illustrating another embodiment of the present invention.
Figure 6:
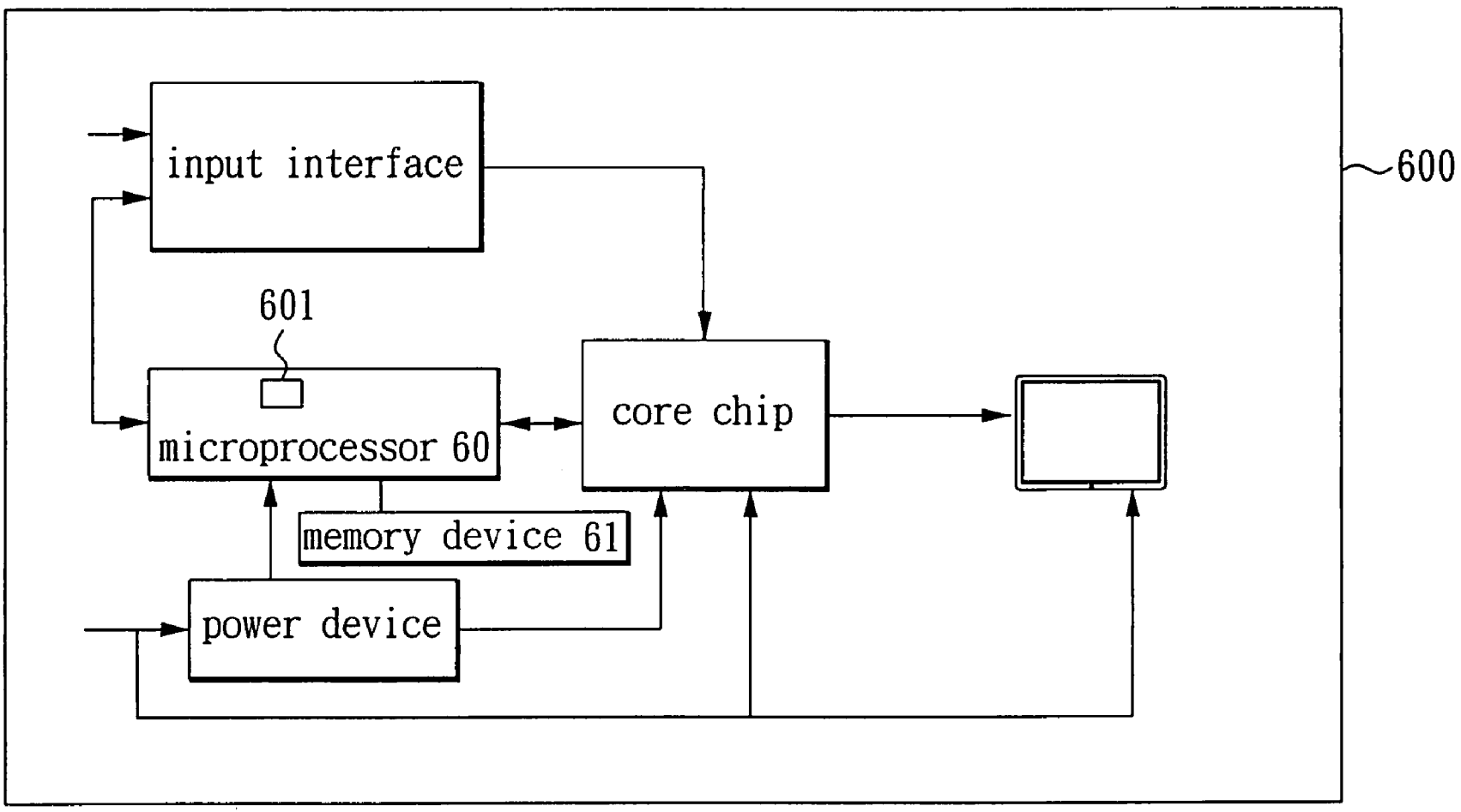
FIG. 6 is a functional block diagram illustrating another embodiment of the present invention.

Please refer to FIG. 5, a flow chart illustrating another embodiment according to the present invention, jointly with the functional block diagram of a liquid crystal display as shown in FIG. 6. In this embodiment, the method is applied on a liquid crystal display 600. In step S501, specified video-signal-timing display parameters must first be calculated. The specified video signal timing, in this embodiment, is selected from one of the following inputted analog signal timings which sharing the same horizontal and vertical frequencies: 640×350, 720×350, 640×400, and 720×400. Aforementioned signal timings can be sub-categorized into three groups: 640×350 and 720×350 (horizontal frequency of 31.5 KHz (positive polarity), vertical frequency of 70 Hz (negative polarity)), 640×400 and 720×400 (horizontal frequency of 31.5 KHz (positive polarity), vertical frequency of 60 Hz (negative polarity)), and 640×400 and 720×400 (horizontal frequency of 31.5 KHz (positive polarity), vertical frequency of 70 Hz (negative polarity)) respectively. In this embodiment, the 640×350 and 720×250 group (horizontal frequency of 31.5 KHz (positive polarity), vertical frequency of 70 Hz (negative polarity)) is chosen as exemplarity for the purpose of demonstrating the involved procedures and principles that are also shared by the other two groups. After the 640×350 and 720×350 video-signal-timing parameters, such as the vertical display location, the horizontal display location, the vertical display size, and the horizontal display size, are calculated, these parameters will then be saved in a memory device 61 of the liquid crystal display 600. In this embodiment, 640×350, 70 Hz is selected as default display signal (step S502), and a flag 601 is set within the microprocessor 60, for which this flag 601 is set up as HIGH for representing 640×350, 70 Hz and then determined whether the inputted video signal is 640×350, 70 Hz(step S503). If the inputted video-signal timing is 640×350, 70 Hz, sequence-signal display parameters are remained as originally displayed; if not, a switch signal can be inputted from the external device, for example, signals inputted from a control-button, or from hot keys of a remote controller. In this embodiment, flag 601 will be set as LOW to represent switching video-signal-timing display parameters, changing from the initial parameters of 640×350, 70 Hz to parameters of 720×350, 70 Hz (step S504), and these switched video-signal-timing display parameters will be outputted and returned to original program operation (step S505). Above embodiments can also be applied on cathode ray tube displays, plasma displays, or any other display devices for which the same objects and functions can also be achieved.

As stated above, the present invention utilizes a horizontal synchronized-signal interrupt value or default video-signal-timing display parameters to recognize video signal timing that conventional displays cannot, so as to achieve the purpose of decreasing errors and corresponding inconvenience to users due to failure to recognize by the display.

Although the present invention has been explained in relation to its preferred embodiment, it is to be understood that many other possible modifications and variations can be made without departing from the spirit and scope of the invention as hereinafter claimed.

What is claimed is:

1. A method for recognizing video signal timing of analog input applied on displays, using horizontal-synchronized-signal interrupt value to determine inputted signal timing, comprising steps as follows:

(A) determining whether an inputted signal timing is altered;

(B) checking whether said altered signal timing is a default signal timing;

(C) deleting said horizontal-synchronized-signal interrupt value;

(D) detecting whether a vertical synchronized signal is a positive trigger; if said vertical synchronized signal is not a positive trigger, continuing to detect said vertical synchronized signal until it becomes a positive trigger;

(E) determining whether said horizontal-synchronized-signal interrupt value is an initial value; if true, initiating an enumerated horizontal-synchronized-signal interrupt program and repeating step (D); if not true, terminating horizontal-synchronized-signal interrupt value counts and obtaining a horizontal-synchronized-signal interrupt value;

(F) whenever an interrupt program is interrupted by a horizontal synchronized signal, increasing and accumulating said horizontal-synchronized-signal interrupt value;

(G) determining whether said horizontal-synchronized-signal interrupt value is greater than a default value; if true, then said inputted signal timing is a first pixel value; if not true; then said inputted signal timing is a second pixel value; and (H) terminating enumerations of horizontal-synchronized-signal interrupts.

2. The method as claimed in claim 1, wherein in step (B), said default signal timing is selected from one of the followings: 640×350, 640×400, 720×350, and 720×400.

3. The method as claimed in claim 1, wherein in step (E), said initial value is zero.

4. The method as claimed in claim 1, wherein in step (G), said default value is 800; said first pixel value is 720; and said second pixel value is 640.

5. The method as claimed in claim 1, wherein said display is at least one of the followings: a liquid crystal display, a liquid crystal television, a plasma television, or a cathode-ray tube display.

6. A method for recognizing video signal timing of analog input applied on a display, comprising steps as follows:

(A) calculating specified video-signal-timing parameters, and save said parameters in said display;

(B) selecting one of said specified video-signal-timing display parameters as a default video-signal-timing value;

(C) determining whether an inputted video-signal-timing display parameter matches with said specified video-signal-timing display parameter selected; if true, maintaining the specified video-signal-timing display parameter selected; if not true, inputting a switch signal from an external device for switching the video-signal-timing display parameters; and (D) outputting said switched video-signal-timing display parameters.

7. The method as claimed in claim 6, wherein in step (A), said each video-signal-timing display parameter is selected from one of the following inputted analog signal timing sharing the same horizontal and vertical frequencies: 640×350, 720×350, 640×400, and 720×400.

8. The method as claimed in claim 7, wherein in step (C), said switching signal inputted by said external device is a control-button inputted signal.

9. The method as claimed in claim 7, wherein said display is at least of the followings: a liquid crystal display, a liquid crystal television, a plasma television, or a cathode ray tube display.

* * * * *